United States Patent [19]

Marchand

[11] Patent Number: 4,688,663

[45] Date of Patent: Aug. 25, 1987

[54] MOTOR AND BRAKE CONTROL FOR A MULTI-STAGE TURBINE ENGINE

[76] Inventor: William C. Marchand, 11339 Roxbury Ave., Detroit, Mich. 48224

[21] Appl. No.: 629,109

[22] Filed: Jul. 9, 1984

Related U.S. Application Data

[63] Continuation-in-part of Ser. No. 376,327, May 10, 1982, Pat. No. 4,492,520.

[51] Int. Cl.[4] ..... B60K 13/02; B60K 41/20

[52] U.S. Cl. ..... 192/4 C; 192/3.34; 60/39.25; 415/152 R

[58] Field of Search ..... 192/4 A, 4 B, 4 C, 3.34, 192/1, 2, 3 R, 3 H; 60/39.25, 602; 73/116, 117.3, 118; 415/115, 150, 151, 152 R, 152 A, 157, 158

[56] References Cited

U.S. PATENT DOCUMENTS

| | | | |
|---|---|---|---|
| 2,421,445 | 6/1947 | Waller | 415/154 |
| 3,232,581 | 2/1966 | Swearingen | 415/147 |
| 3,243,159 | 3/1966 | Hefler et al. | 415/156 |
| 3,923,127 | 12/1975 | Radcliffe et al. | 192/3 H X |
| 3,972,644 | 8/1976 | Johnson | 415/151 X |
| 4,003,199 | 1/1977 | Bell et al. | 415/163 X |
| 4,195,472 | 4/1980 | Robinson | 192/4 C X |
| 4,220,008 | 9/1980 | Wilber et al. | 60/602 |
| 4,274,253 | 6/1981 | Bolliger et al. | 60/39.25 X |
| 4,356,447 | 10/1982 | Honig et al. | 73/117.3 X |
| 4,492,520 | 1/1985 | Marchand | 415/150 |

FOREIGN PATENT DOCUMENTS

| | | | |
|---|---|---|---|
| 986680 | 8/1951 | France . | |
| 1084552 | 1/1955 | France . | |
| 753316 | 7/1956 | United Kingdom | 415/152 |

*Primary Examiner*—George H. Krizmanich
*Attorney, Agent, or Firm*—Remy J. VanOphem

[57] ABSTRACT

A servo mechanical control for efficiently bringing a rotating turbine wheel of a turbine engine having a multi-stage stator assembly to a non-rotating condition and for maintaining the turbine wheel in a non-rotating condition. The servo mechanical control includes a detector for detecting the direction of rotation of the turbine wheel and a control device interconnected with the multi-stage stator assembly and operable, in response to the detection of the turbine wheel in either predetermined direction, to displace the multi-stage stator assembly to a position causing a reverse torque on the turbine wheel. The detector preferably consists of at least one brake body pivotally interconnected with the vehicle and selectively operable to engage the output shaft of the turbine wheel. When engaged with the output shaft, the brake body is pivoted in response to angular motion of the turbine wheel. The control device preferably includes a piston and cylinder assembly interconnected with the multi-stage stator assembly and a valve responsive to the angular position of the brake body to selectively interconnect the sides of the piston and cylinder assembly with a pump and a sump.

26 Claims, 18 Drawing Figures

F
N
R

MOTOR AND BRAKE CONTROL FOR A MULTI-STAGE TURBINE ENGINE

CROSS-REFERENCE

The present application is a continuation-in-part application based on copending U.S. patent application Ser. No. 376,327 filed May 10, 1982, now U.S. Pat. No. 4,492,520, issued on Jan. 8, 1985 entitled "Multi-Stage Vane Stator For Radial Inflow Turbine".

BACKGROUND OF THE INVENTION

1. Field of the Invention

The present invention relates to gas turbine engines for powering automotive and other vehicles and, more particularly, to a gas turbine engine having a multi-stage stator assembly for controlling the forward and reverse motion of the output shaft of the turbine, including a neutral position between a forward and reverse stage of the multi-stage stator assembly, and provides a servo mechanical control for accurately positioning the multi-stage stator assembly in a decelerating position when desired, and for maintaining the multi-stage stator assembly in the neutral position when the vehicle is stationary.

2. Description of the Prior Art

It is known in turbine engines to provide adjustability in the nozzle blades which direct the flow of the gases to the blades of the turbine rotor, in a manner such that the angle of incidence of the stator vanes relative to the turbine blades is most suitable for maximum efficiency at different speeds and loads. Such adjustability has been accomplished by rotating the blades on their central axis to effect the flow path therebetween. Such stator vanes have been rotated by means of inner and outer gear rings, levers, or cam devices to accomplish different incidence angles relative to the turbine wheel. To function well, the trailing edge of the stator vanes must come as close as possible to the outer ends of the turbine vanes, such as to favor laminar flow. However, the stator vanes must be spaced sufficiently distant from the outer ends of the turbine vanes so as not to interfere therewith as the stator vanes pivot. Thus, substantial leakage occurs between the stator vanes and the turbine blades at some angular positions of the stator vanes. A disadvantage of such devices is that their designs often fail to prevent leakage of gases between the end portions of the stator vanes and their inner and outer mounting rings and, consequently, prevent precise and positive control of the turbine. In addition, such parts often are subjected to substantial vibration, flutter, wear, and seizure. Moreover, designs of this type are costly to fabricate and assemble, and have been very expensive to maintain. Finally, the shape of the pivotable stator vane, when used for reverse motion, does not provide for a smooth and efficient transfer of power to the turbine engine.

The above described prior art is exemplified by the following patents:

| COUNTRY | PATENT NO. | ISSUED |
|---|---|---|
| United States | 3,232,581 | February 1, 1966 |
| United States | 3,243,159 | March 29, 1966 |
| United States | 3,972,644 | August 3, 1976 |
| United States | 4,003,199 | January 18, 1977 |

These prior art arrangements for varying the positions of vanes in a stator assembly in a radial inflow turbine are usually only good for one position and have been found to be inadequate to properly and precisely control the flow of gases to the turbine wheel of the turbine, for varying speed and loads.

It is also known in turbine engines to provide a multi-stage stator assembly having a plurality of sets of stator vanes, each having a different fixed angle of incidence. The multi-stage stator assembly is adjustably positionable axially relative to the turbine blades such as to bring any preselected one of the sets of stator vanes into operative alignment with the turbine blades. Such adjustability of the position of the multi-stage stator assembly is accomplished by various driving means to securely position the multi-stage stator assembly in one of a limited number of discrete preselected operating positions, each corresponding to the alignment of one of the sets of stator vanes with the turbine blades. A disadvantage of such devices is that their designs only provide for a small predetermined number of power levels and, accordingly, a smooth transition between these positions is often unavailable. Furthermore, due to the existence of such discrete preselected operating positions, the responsiveness of the turbine engine to differing speeds and loads is somewhat limited.

The above described prior art is exemplified by the following patents:

| COUNTRY | PATENT NO. | ISSUED |
|---|---|---|
| United States | 2,421,445 | June 3, 1947 |
| United States | 4,220,008 | September 2, 1980 |
| Great Britain | 738,987 | October 26, 1955 |
| Great Britain | 753,316 | July 25, 1956 |
| France | 986,680 | August 3, 1951 |
| France | 1,084,552 | January 20, 1955 |

In the parent application to the present continuation-in-part application, it was proposed to provide a multi-stage stator assembly having a reverse stage and a plurality of discrete forward stages. However, unlike the prior art, the parent application provided for the adjustable selective positioning of the multi-stage stator assembly in any of the continuous positions between the full reverse stage and the lowest output forward stage, so as to provide a continuously and smoothly variable selection of output. In the parent application, the precise positioning of the multi-stage stator assembly relative to the turbine blades was accomplished either by means of a piston cylinder arrangement or by a crank arm arrangement.

Furthermore, in the parent application, a neutral position was provided for, disposed approximately midway between the full reverse position and the first forward stage of the multi-stage stator assembly.

SUMMARY OF THE INVENTION

The present invention provides a secondary control means for a gas turbine engine having a multi-stage stator assembly for controlling the forward and reverse motion of the output shaft of a turbine, the secondary control assembly operating to properly position the multi-stage stator assembly for a deceleration and a neutral output of the turbine rotor.

In general, the present invention provides for a secondary control member interconnected with the multi-stage stator assembly to reciprocably drive the multi-stage stator assembly in an axial direction when a neutral condition is selected. A detector is provided to detect the direction of rotation of the turbine rotor. The secondary control member is selectively responsive to the detector to axially position the multi-stage stator assembly relative to the turbine rotor in a direction compensating for the detected angular motion of the turbine rotor such that a neutral position of the multi-stage stator assembly relative to the turbine rotor is ultimately found and maintained. A brake may also be provided to inhibit the rotation of the turbine rotor.

In the preferred embodiment of the present invention the detector consists of at least one brake body pivotally interconnected with the vehicle. The brake body is provided with a braking surface selectively displaceable into engagement with the output shaft of the turbine rotor when the neutral condition is selected. A portion of the rotational motion of the output shaft of the turbine rotor is transferred to the main brake body such as to pivot the brake body in a first or second predetermined angular position. Furthermore, in the preferred embodiment, the secondary control members consist of a cylinder and a piston reciprocably disposed in the cylinder such as to divide the cylinder into a first chamber and a second chamber each, respectively, interconnected with a pump by means of a first passageway and a second passageway. Both the first passageway and the second passageway include passageway portions extending through the brake body.

A first valve and a second valve are provided between the brake body and the vehicle such as to selectively open and close the first and second passageways depending on the angular position of the brake body. The first passageway is open for fluid communication between the pump and the first chamber in the first predetermined angular position of the brake body, while the second passageway is closed against fluid communication between the pump and the second chamber, thus displacing the multi-stage stator assembly in a first predetermined axial direction. Similarly, in the second predetermined angular position of the brake body, the second passageway is opened while the first passageway is closed, thereby displacing the multi-stage stator assembly in a second predetermined axial direction opposite the first predetermined axial direction. In an intermediate position between the first and second predetermined angular positions of the brake body, both the first and second passageways are closed and, accordingly, the multi-stage stator assembly is maintained in a fixed position.

Thus, when a neutral position is selected, the brake body engages the output shaft of the turbine rotor to decelerate the turbine rotor. Furthermore, the brake body pivots relative to the vehicle such as to open one of the first or second passageways to displace the piston within the cylinder and adjust the position of the multi-stage stator assembly in a direction to apply a braking torque on the turbine rotor. If too much braking torque has been applied such as to provide a reverse direction of rotation to the output shaft, the brake body will detect this motion and pivot to the other predetermined angular position, to thereby displace the piston in the opposite direction and reposition the multi-stage stator assembly. The process is repeated until the turbine rotor is stationary. Furthermore, the brake body detects any undesirable initiation of rotation by the turbine rotor arising from any instability in the turbine engine and acts to maintain the neutral condition. Thus, in the neutral position of the secondary control assembly, the turbine rotor is decelerated or maintained in a steady state condition independently of the flow rate of gases to the turbine engine.

It is a primary object of the present invention to provide a turbine engine of improved construction for driving a vehicle, which turbine engine avoids one or more of the shortcomings of the prior art.

It is another object of the present invention to provide improved components for controlling a turbine engine for driving a vehicle, which improved components eliminate the need for a clutch and a gear shift for transferring power from the power turbine shaft to a vehicle transmission.

It is still another object of the present invention to provide a turbine engine of improved construction for driving a vehicle, which turbine engine has a shiftable multi-stage stator assembly for transferring power directly from the turbine shaft to a vehicle transmission as motive power for forward motion, reverse motion, and a stable neutral non-driving state, as the gasifier of the turbine is running at any speed.

It is still another object of the present invention to provide an improved, radial inflow turbine engine for driving a vehicle, which turbine engine has control components of greatly simplified construction, to produce vehicle braking by reversing the direction of gas flow to the turbine wheel of the turbine, and to automatically avoid a reversing motion of the vehicle at the completion of the braking operation.

It is yet another object of the present invention to provide a servo mechanical control to accurately locate and maintain a neutral position for a multi-stage stator assembly of a turbine engine of the type described above.

These and the many other objects, features and advantages of the present invention will become apparent to those skilled in the art when the following detailed description of the preferred embodiment is read in conjunction with the drawings appended hereto.

BRIEF DESCRIPTION OF THE DRAWINGS

In the drawings appended hereto, wherein like reference numerals refer to like components throughout.

DETAILED DESCRIPTION OF THE PREFERRED EMBODIMENT

Figure 1:
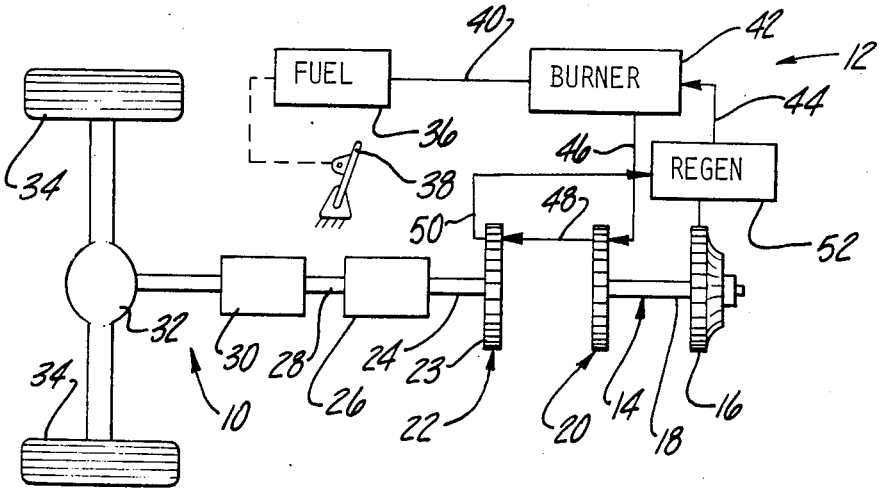
FIG. 1 is a schematic view of a motor vehicle having a turbine engine assembly embodying the present invention.

Referring to FIG. 1, a motor vehicle 10, illustrated in diagrammatic form, has a turbine engine assembly 12, which may be of the two-shaft type, including a free turbine or power turbine 22 and a spool 14 having a compressor 16 connected by a shaft 18 to a gasifier turbine 20. The power turbine 22 embodying the present invention includes a turbine impeller wheel 23 fixed on a free-wheeling output shaft 24 which is connected through a gear reduction unit 26 to a drive shaft 28. The drive shaft 28 is coupled to a transmission 30 to transfer drive power thereto. The drive power is thence transferred from the transmission 30 through a differential and rear axle assembly 32 to the drive wheels 34 of the motor vehicle 10.

A fuel control 36 for the motor vehicle 10 is connected to an accelerator pedal 38 to supply fuel at a suitable rate through a conduit 40 to a burner 42 of the turbine engine assembly 12. The burner 42 is supplied with a source of air through a conduit 44 connected indirectly to the outlet of the compressor 16. Combustion products, including hot gases, from the burner 42 are directed through outlet lines 46 and 48 for driving the power turbine 22 and the gasifier turbine 20. The exhaust from the power turbine 22 and the gasifier turbine 20 may be directed through a conduit 50 to a regenerator 52 for preheating air from the compressor 16 prior to its passage along the conduit 44 into the burner 42.

Figure 2:
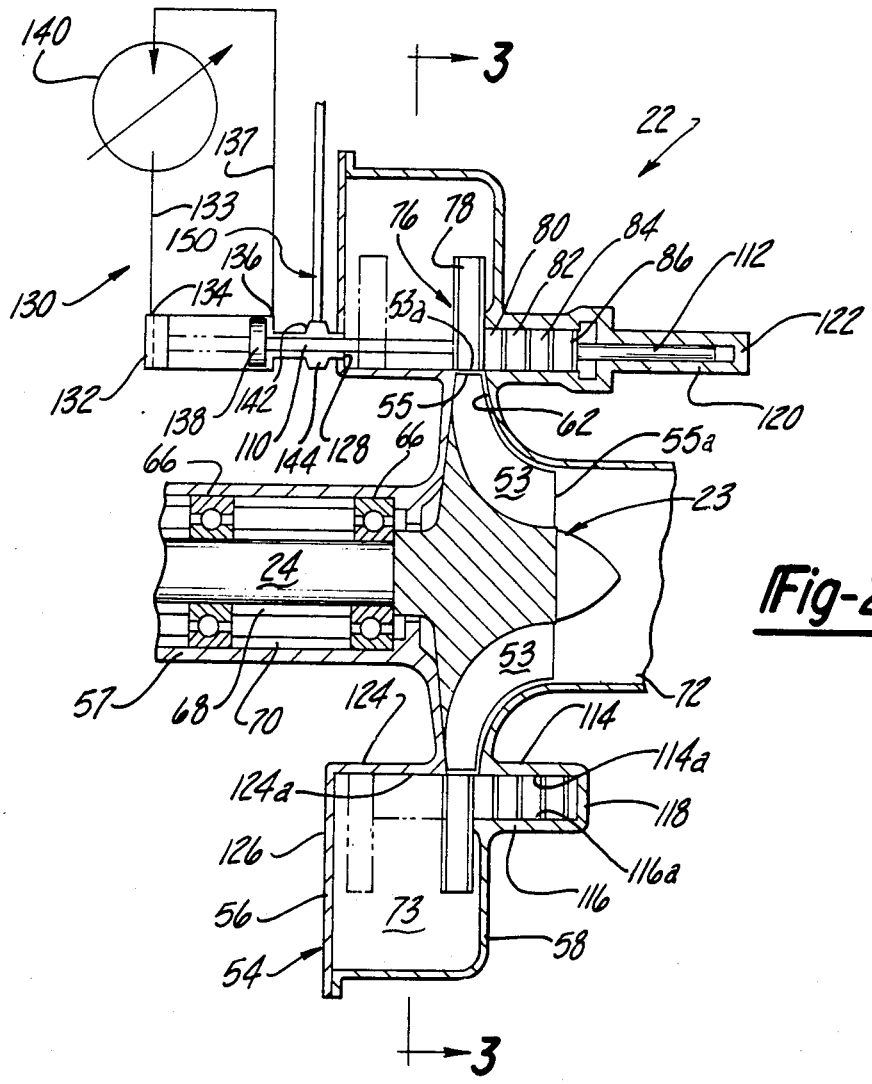
FIG. 2 is a fragmentary cross-sectional view of a power turbine having a shiftable multi-stage stator assembly and illustrating a preferred embodiment of the present invention.
Figure 3:
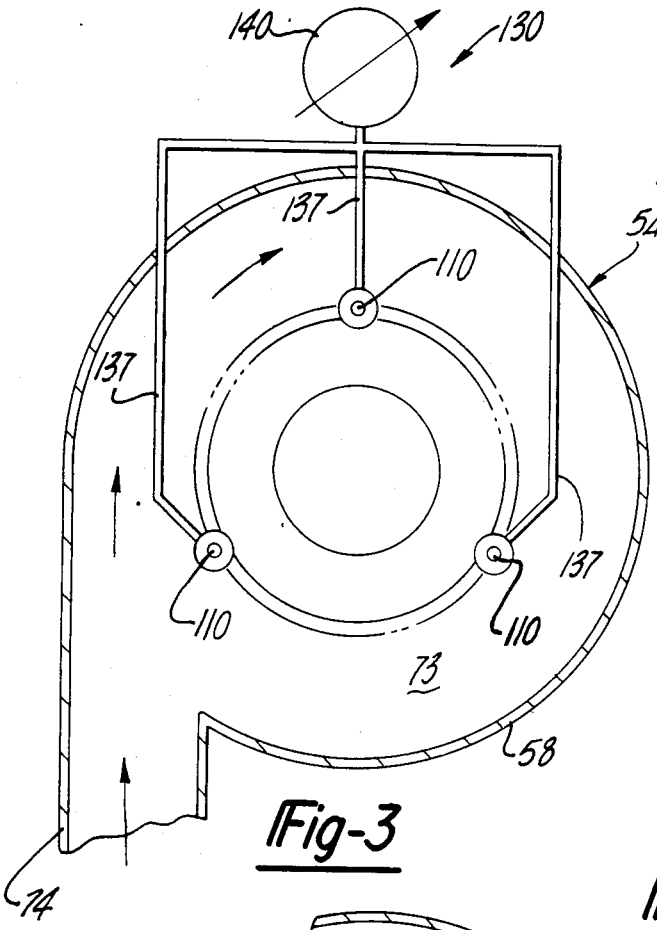
FIG. 3 is a schematic sectional view taken along line 3—3 of FIG. 2.

In accordance with the teachings of the present invention, a preferred embodiment of the power turbine 22, as best shown in FIG. 2, includes the turbine impeller wheel 23 having suitable axial flow vanes 53 mounted for free rotation within an annular housing 54. The annular housing 54 includes housing portions 56 and 58 which are complementary and mating so as to cooperate to define therebetween an annulus 73 having an inlet duct 74, as shown in FIG. 3, for entry of hot gases and combustion products from the burner 42 into the annular housing 54. In addition, the housing portions 56 and 58 define a circumferential inlet 62, as shown in FIG. 2, for the gases to the axial flow vanes 53 of the turbine impeller wheel 23. Each axial flow vane 53 has a radial inlet end 55 adjacent the circumferential inlet 62 and an axial outlet end 55*a*. The housing portion 56 of the annular housing 54 includes an axial sleeve portion 57 which mounts to the free wheeling output shaft 24 of the turbine impeller wheel 23 for free rotation relative thereto by means of suitable bearing elements 66 maintained in spaced apart relationship by spacer sleeves 68 and 70. The housing portion 58 of the annular housing 54 is likewise configured to define an inner passage 72 for conveying combustion products from the axial flow vanes 53 to the regenerator 52 for preheating compressed air from the compressor 16 prior to entering the burner 42. As shown in FIG. 3, the gases are directed by means of the inlet duct 74 such as to flow around the annulus 73 in the annular housing 54. The direction of the flow of gases through the circumferential inlet 62 is controlled by means of a stator assembly 76, shown in FIGS. 2 and 4 and hereinafter to be described.

Figure 4:
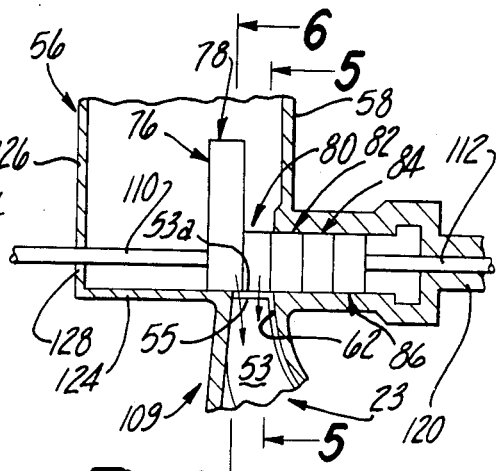
FIG. 4 is a fragmentary view similar to a portion of FIG. 2, greatly enlarged, showing vanes of two stages of the multi-stage stator assembly, a forward stage and a reverse stage, each disposed over and partially in line with the inlet of the power turbine as determined by the servo mechanism such as to provide no net torque to the power turbine.
Figure 5:
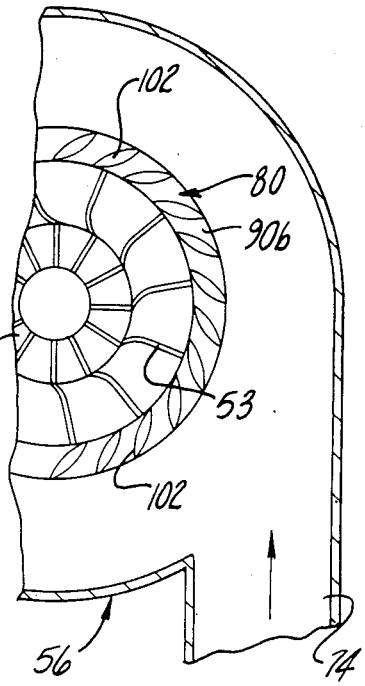
FIG. 5 is a sectional view taken along line 5—5 of FIG. 4 through the power turbine of FIG. 2 with the vanes of a forward stage of the multi-stage stator assembly aligned with the inlet of the power turbine for inducing forward rotation of the turbine wheel.
Figure 6:
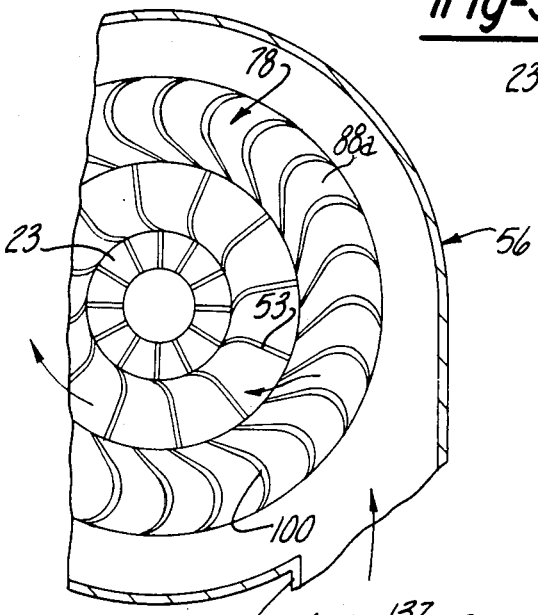
FIG. 6 is a sectional view taken along line 6—6 of FIG. 4 wherein the vanes of a reverse stage of the multi-stage stator assembly are illustrated aligned with the inlet of the power turbine for inducing reverse rotation of the turbine wheel.
Figure 7:
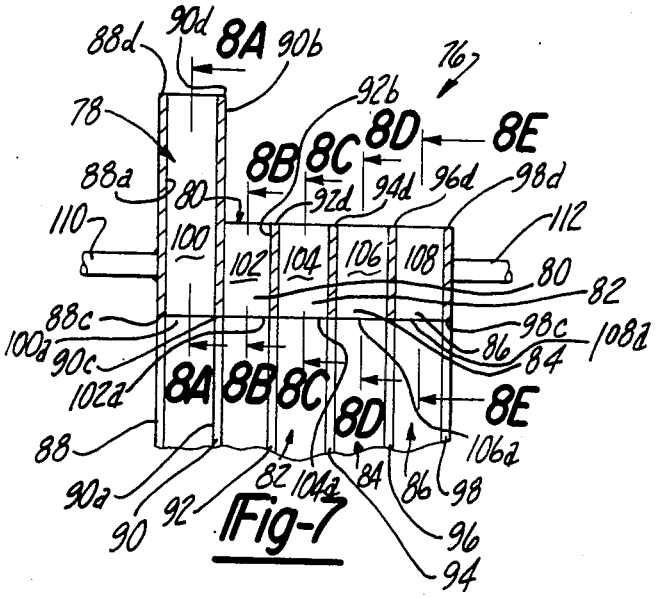
FIG. 7 is a partial cross-sectional view through the multi-stage stator assembly of the power turbine of FIG. 2 illustrating supporting shaft means therefor.

Referring now in general to FIGS. 2, 4 through 7, and 8A through 8E, the stator assembly 76 consists of several stages which, as shown in the drawing in FIGS. 2, 4 and 7, includes a reverse stage 78 and four forward stages: a first forward stage 80, a second forward stage 82, a third forward stage 84 and a fourth forward stage 86, respectively.

As best shown in FIG. 7, the different reverse and forward stages 78, 80, 82, 84, and 86 are united into a unitary construction consisting of a plurality of flat, axially spaced ring members 88, 90, 92, 94, 96 and 98, between which are mounted a reverse set of vanes 100 and four forward sets of vanes 102, 104, 106 and 108. The sets of vanes 100, 102, 104, 106 and 108 may be suitably secured between adjacent side wall surfaces of the axially spaced ring members 88, 90, 92, 94, 96 and 98 by brazing or other suitable means. The angles of incidence of the individual vanes of each set of vanes 100, 102, 104, 106 and 108, as illustrated in FIGS. 8A through 8E, respectively, are different, one from another. Each vane of the sets of vanes 100, 102, 104, 106 and 108 is suitably dimensioned and positioned such that the vane does not interfere with the rotation of the turbine impeller wheel 23, while minimizing the leakage therebetween.

By way of specific example, the reverse set of vanes 100 constituting the reverse stage 78 are shown in FIG. 7 as being mounted between the axially spaced ring members 88 and 90 and secured in bridging relationship to the corresponding side wall surfaces 88*a* and 90*a*, respectively. The next adjacent stage, the first forward stage 80, is contiguous with and abuts the reverse stage 78. The first forward stage 80 consists of the forward set of vanes 102, best shown in FIG. 8B, of a different shape and configuration from the reverse set of vanes 100, and are likewise fixedly supported at their opposite edges between the opposed side wall surfaces 90*b* and 92*b* of the axially spaced ring members 90 and 92, respectively, as depicted in FIG. 7. In a similar manner, the next adjacent forward sets of vanes 104, 106 and 108, constituting the second, third, and fourth stages 82, 84, and 86, respectively, are contiguously and sequentially secured in abutting relationship between the axially spaced ring members 92 and 94, 94 and 96, and 96 and 98, respectively, to form a rigid unitary multi-stage unit for the stator assembly 76. The axially spaced ring members 88, 90, 92, 94, 96 and 98 are provided with circular inner edges 88*c*, 90*c*, 92*c*, 94*c*, 96*c* and 98*c*, respectively, of a common inner diameter and circular outer edges 88*d*, 90*d*, 92*d*, 94*d*, 96*d* and 98*d*, respectively, of a common outer diameter.

Figure 8A:
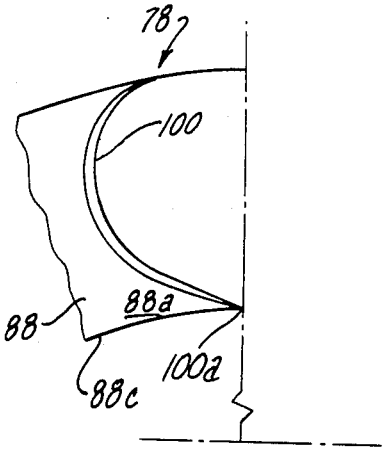
FIGS. 8A through 8E, inclusive, are sectional views through various stages of the multi-stage stator assembly taken, respectively, along lines 8A—8A through 8E—8E of FIG. 7 and illustrating the various pitch angles of the vanes of the various stages of the multi-stage stator assembly.
Figure 8B:
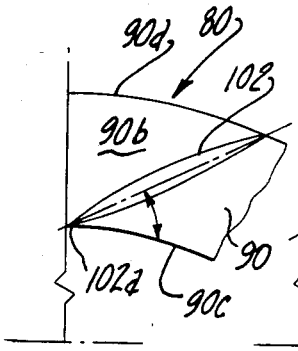
Figure 8C:
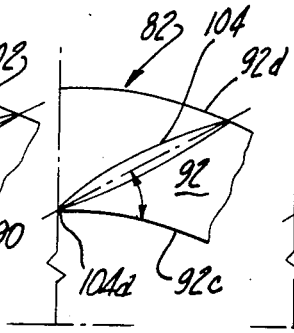
Figure 8D:
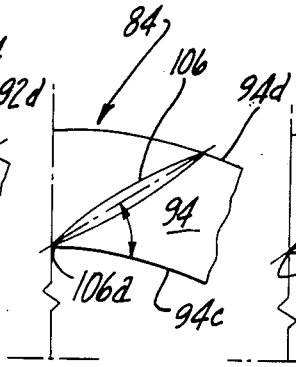
Figure 8E:
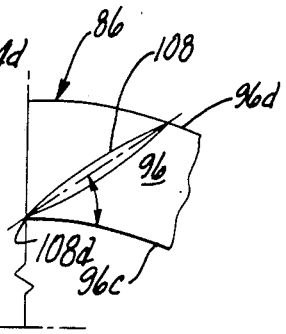

It should be noted that the individual forward vanes of the forward sets of vanes 102, 104, 106, and 108 are approximately straight, as is well known. However, the individual reverse vanes of the reverse set of vanes 100 are curved, as best shown in FIGS. 6 and 8A. A larger outer diameter combined with the appropriate contour of these individual reverse vanes facilitates the smooth transition of the flow of gases from a counterclockwise direction to a clockwise direction, as viewed in FIG. 6, minimizing the loss of momentum, as compared with prior art reverse vanes which are approximately straight and cause an abrupt change in the direction of the flow of gases.

With reference now to FIG. 2, it is observed that the turbine blades 53 have an outside diameter at their radial inlet ends 55 such that a minimum clearance is provided to enable relative rotation thereof with respect to the trailing or inner edges 100*a*, 102*a*, 104*a*, 106*a* and 108*a* (FIGS. 8A through 8E) of the sets of vanes 100, 102, 104, 106 and 108, respectively. This extremely close juxtaposition of the inner edges 100*a*, 102*a*, 104*a*, 106*a* and 108*a* of the sets of vanes relative to the outer diametrical marginal edges 53*a* of the axial flow blades 53 precludes creation of turbulent flow and maintains instead a desirable laminar flow for the hot gases, thereby significantly enhancing the efficiency of the power turbine 22.

In order to selectively position the individual stages 78, 80, 82, 84 and 86 of the stator assembly 76 opposite the circumferential inlet 62 defined by the housing portions 56 and 58 for the turbine impeller wheel 23, suitable stator mounting means 109 are provided, as shown in FIG. 4. For this purpose, a plurality of rod elements 110 and 112 are suitably fixedly secured to the ring members 88 and 98, respectively, in coincident aligned relationship to one another, and parallel to the axis of rotation of the turbine impeller wheel 23. As seen in FIG. 2, the stator assembly 76 may be selectively shifted between the first position shown in full line and the second position shown in phantom line, as well as individual intermediate positions therebetween. It is observed that the housing portion 58 includes inner and outer axially extending flange portions 114 and 116 in the first position of the stator assembly 76, having surfaces 114*a* and 116*a* engaging the circular inner and outer edges 92*c*, 92*d*, 94*c*, 94*d*, 96*c*, 96*d*, 98*c* and 98*d* of the ring members 92, 94, 96 and 98, which demarcate the various forward stages 80, 82, 84 and 86 of the stator assembly 76.

It is further seen that the plurality of rod element 112 provided for the assembly are disposed equally spaced circumferentially around the axis of rotation of the turbine assembly 12. An end wall 118 serves to close the opening between the inner and outer axially extending flange portions 114 and 116. The end wall 118 integrally includes therewith a plurality of axially disposed sockets 120 closed at their ends 122. The axially disposed sockets 120 each receive therein for guiding movement the outer end portion of one of the plurality of rod elements 112. The axially disposed sockets 120, however, restrain rotational movement of the stator assembly 76 about the axis of rotation of the turbine impeller wheel 23. The housing portion 56 likewise includes an axial flange portion 124 of like diameter and aligned with the inner axially extending flange portion 114 of the housing portion 58. A surface 124*a* of the flange portion 124 provides a bearing surface for the inner peripheral edge portions 88c, 90*c*, 92*c*, 94*c* 96*c* and 98*c* of the axially spaced ring members 88, 90, 92, 94, 96 and 98, respectively.

Still referring to FIG. 2, it is seen that the housing portion 56 includes a vertical wall portion 126 which includes apertures 128 adjacent the axial flange portion 124, to support end portions of the rod element 110 in sliding bearing engagement.

Figure 9:
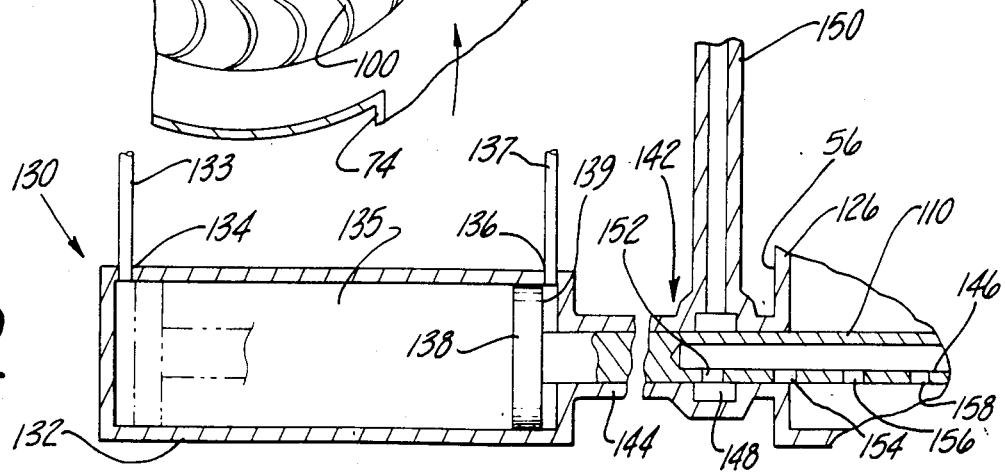
FIG. 9 is a partial view of the power turbine illustrated in FIG. 2, showing a cool air pressure unit to keep hot gases from heating up the control unit.

In order to control the movement of the stator assembly 76 relative to the circumferential inlet 62 of the turbine impeller wheel 23 during a forward or reverse driving condition, a primary control assembly 130 is provided which, in the example of structure shown in FIGS. 2 and 9, includes a suitable source of fluid energy and means to convert the fluid energy to mechanical force and motion. The primary control assembly 130, best shown in FIG. 9 herein, includes a linear actuator in the form of a double acting cylinder 132 having ports 134 and 136, accommodating fluid lines 133 and 137, respectively, in its cap end 135 and its root end 139. A piston 138 of the linear actuator is affixed to the rod element 110 of the stator assembly 76. A variable displacement motor 140 is shown connected to the double acting cylinder 132 to suitably extend or retract the piston 138 and the rod element 110 connected thereto so as to selectively move the stator assembly 76 parallel to the axis of rotation of the turbine impeller wheel 23 so that a preselected stage of the stator assembly 76 is positioned opposite the circumferential inlet 62 of the turbine impeller wheel 23.

In order to shield the linear actuator of the primary control assembly 130 from undue heat from the power turbine 22, a heat shield 142 is shown interposed the housing portion 56 and the linear actuator as shown in FIG. 9. A sleeve 144 is provided encircling the rod element 110 and extending between the end of double acting cylinder 132 and the vertical wall portion 126 of the housing portion 56. An annular passage 148 is formed in the sleeve 144 adjacent the rod element 110. A hollow tube 150 is interconnected with the annular passage 148 to introduce a suitable amount of cool air from the compressor 16.

The air so received is forced from the annular passage 148 and bled into an axial bore 146 in the rod element 110 via a plurality of radial openings 152, 154, 156 and 158 in the rod element and further is directed into the annular housing 54 of the stator assembly 76. Since the air from the compressor 16 is colder and of a greater mass than the hot combustion products in the power turbine 22, the heat from the latter is thus prevented from reaching the control assembly 130 such as to avoid rendering it inoperative due to excessive heat.

Referring again to FIG. 4, it is observed that the stator assembly 76 has been shifted a slight distance axially to the left as compared to the most rightward position of the stator assembly illustrated in FIG. 2. In the position of the stator assembly 76 shown in FIG. 4, the reverse stage 78 and the first forward stage 80 of the stator assembly are each partially in alignment with the circumferential inlet 62 defined by the housing portion 56 for the turbine impeller wheel 23. In this position of the stator assembly 76 and with the gasifier turbine 20 of the turbine engine assembly 12 running at any speed, the force and direction of the hot gases passing through the reverse set of vanes 100 of the reverse stage 78 are nullified by the force and direction of the gases passing through the forward set of vanes 102 of the first forward stage 80 of the stator assembly 76. As a consequence, the net torque experienced by the turbine impeller wheel 23 is zero and the turbine impeller wheel 23 is brought into a neutral state regarding the energy output and the direction of rotational output. This action can be better understood by referring to FIGS. 5 and 6. With reference to FIG. 5, it is seen that the gases passing through the set of vanes 102 of the forward stage 80 strike the axial flow vane 53 of the turbine impeller wheel 23 in a direction to cause counterclockwise rotation of the turbine impeller wheel, whereas, with reference to FIG. 6, it is seen that the hot gases are controlled in a direction by means of the set of vanes 100 of the reverse stage 78 of the stator assembly 76 to cause a clockwise rotation of the turbine impeller wheel 23. Upon summing the force components illustrated in FIGS. 5 and 6, it can be appreciated that a zero torque output of the turbine impeller wheel 23 may be obtained upon the stator being so positioned axially, as illustrated in FIG. 4.

In considering the operation of the turbine engine assembly 12 just described, it will be seen that it differs from conventional variable vane stators in that it employs a stator construction in which the various stages of differently pitched vanes are securely fastened to the spaced apart ring members 88 through 98, making up the stator assembly 76, whereas in prior constructions, the vanes are provided with means for pivoting the vanes relative to their mounting structure. The turbine engine assembly 12 employs the principle of mechanically moving the stator assembly 76 parallel to the axis of rotation of the turbine impeller wheel 23 to present various sets of vanes each having a different predetermined fixed pitch angle, opposite the inlet end of the turbine impeller wheel. Furthermore, the stator assembly 76 differs in that the reverse vanes have a curved shape which minimizes the loss of momentum experienced by the gases flowing past the reverse vanes.

In driving operation, hot gases and combustion products from the burner 42 are directed through the outlet lines 46 and 48 to the gasifier turbine 20 and thence, along the inlet duct 74 of the annular housing 54 of the power turbine 22. The operator of the motor vehicle 10, upon desiring a given forward mode of propulsion, actuates the variable displacement motor 140 through an appropriate degree of movement. This causes the piston 138 of the primary control assembly 130 to slide in its double acting cylinder 132 and, thereby, to actuate the rod element 110 affixed to the stator assembly 76. The stator assembly 76 is thereby positioned so that the set of vanes corresponding to a preselected stage of the rotor are positioned in radial alignment with the radial inlet end 55 of the axial flow vanes 53 of the turbine impeller wheel 23 and across the circumferential inlet 62 for exhausting the gases from the annular housing 54. Assuming that the operator desires the first forward speed stage 80, the stator assembly 76 would thus have been shifted so that the forward set of vanes 102 would be in alignment with the inlet 62, seen in FIG. 5, and the turbine impeller wheel 23 would absorb rotational energy corresponding to a first forward speed. If on the other hand other forward modes of movement were desired, the operator would actuate the variable displacement motor 140 in an appropriate amount and direction to cause one of the remaining sets of the vanes 100, 104, 106 or 108 to be positioned in a like manner across the inlet 62 to suitably energize the turbine impeller wheel 23.

If the operator desired to cause a braking action to be imparted to the vehicle, he would actuate the variable displacement motor 140 to cause downshifting from a higher to a lower forward stage of the stator assembly. Alternatively, further braking action is obtained when both the first forward stage 80 and the reverse stage 78 are simultaneously positioned across the circumferential inlet 62, in the manner as shown in FIG. 4. Since the first forward stage 80 normally tends to cause rotation of the turbine impeller wheel 23 in a forward direction, while the reverse stage 78 tends to rotate it in a reverse direction, it is seen that the sum of energies absorbed from each of the stages 78 and 80 is cancelled one by the other and, hence, rotation of the free wheeling output shaft 24 of the turbine impeller wheel 23 is inhibited. Moreover, since the end of the free wheeling output shaft 24 is directly coupled to the transmission 30 of the motor vehicle 10 through the gear reduction unit 26, such braking action is imparted directly through the drive train to the drive wheels of the motor vehicle 10.

Figures 10, 11, 12, 13, 14:
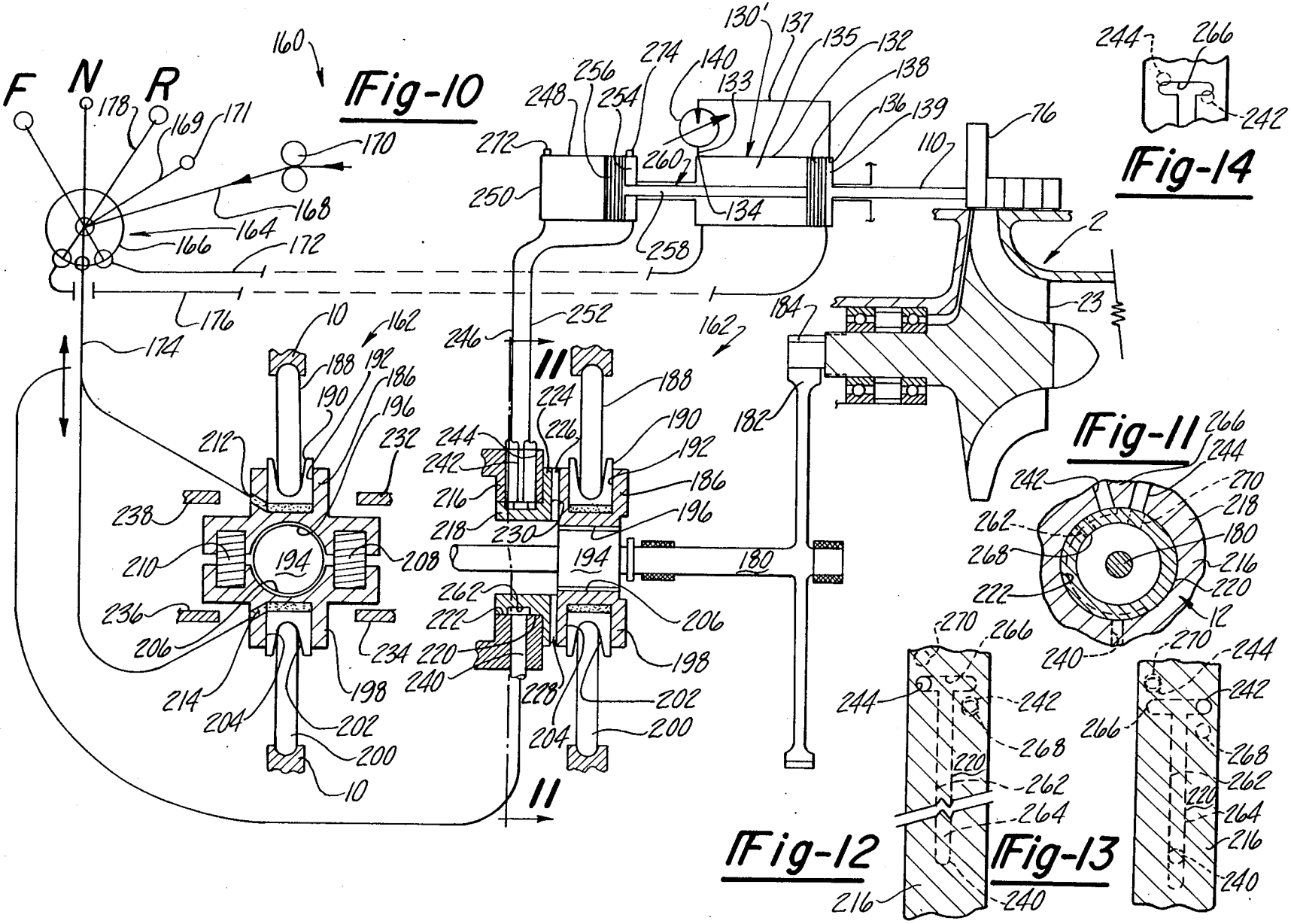
FIG. 10 is a schematic view of the servo mechanical control according to the present invention for decelerating or braking the power turbine of FIGS. 1 through 9 and for maintaining the multi-stage stator assembly thereof in a neutral position.
FIG. 11 is a partial sectional view taken along lines 11—11 of FIG. 10 and illustrating the valving assembly of the servo mechanism thereof.
FIGS. 12 and 13 are developed views of the valving assembly showing in a plonar developed plan view the cylindrical valve member of FIG. 11 and illustrating the valving assembly in two extreme relative positions.
FIG. 14 is a partial developed view illustrating the valving assembly in an intermediate or partial bleed position between the extreme relative positions of FIGS. 12 and 13.

FIGS. 10 through 13 illustrate an example of a servo mechanical control apparatus 160 representing an improvement over the use of the primary control assembly 130, described above, for regulating the position of a stator assembly 76 relative to the turbine impeller wheel 23. The servo mechanical control apparatus 160, as best shown in FIG. 10, includes a primary control assembly 130′, a secondary control assembly 162, and a hydraulic controller 164 selectively operable to actuate the primary control assembly 130′ or the secondary control assembly 162. The secondary control assembly 162 is shown by use of a drafting technique of Dutch projection, as viewed in two different directions in FIG. 10.

As shown schematically in FIG. 10, the hydraulic controller 164 has a valve box 166 interconnected by a supply line 168 with a source of pressurized hydraulic fluid from a pump 170 and is further interconnected by a sump line 169 with a sump 171. The hydraulic controller 164 is also provided with a first, a second, and a third outlet line 172, 174, and 176, respectively, each selectively interconnectable with either the pressurized hydraulic fluid from the pump 170 by way of the supply line 168, or with the sump 171 by way of the sump line 169, by operation of a lever 178. The first and third lines 172 and 176 extend from the valve box 166, respectively, to the cap end 135 and the root end 139 of the double acting cylinder 132 of the primary control assembly 130′ such as to selectively, through operation of the lever 178, communicate the pressurized hydraulic fluid from the pump 170 with the double acting cylinder 132 to selectively displace the piston 138 in the manner described above with respect to the primary control assembly 130. The piston 138 is interconnected by means of the rod element 110 to the stator assembly 76 in the manner described previously. The variable displacement motor 140 is connected by lines 133 and 137, respectively, to the cap end 135 and the root end 139 of the double acting cylinder 132 to selectively vary the relative pressures therein and directly control the specific position of the piston 138.

Thus, when the lever 178 is operated so as to be in a forward driving position F or reverse driving position R, high pressure fluid is delivered along the lines 172 and 176 to the double acting cylinder 132, and the variable displacement motor 140 is operated to position the stator assembly 76 in the manner described previously. It will be appreciated by those skilled in the art that the variable displacement motor 140 may be coupled mechanically with the valve box 166 in a manner such that the lever 178 operates both the hydraulic controller 164 and the variable displacement motor 140 such that a single control is operated to both select between a forward, a reverse or a neutral condition and to select the actual output level of the power turbine 22.

When the neutral position N of the lever 178 is selected, the first and third outlet lines 172 and 176 are interconnected with the sump line 169 to deactivate the primary control assembly 130'.

The second outlet line 174 of the hydraulic controller 164 extends to the secondary control assembly 162. The secondary control assembly 162 is mounted to the motor vehicle 10 adjacent an output shaft 180 rotatably driven through appropriate intermeshing gears 182 and 184 by the turbine impeller wheel 23 of the power turbine 22.

The secondary control assembly includes a first brake body 186 pivotally mounted to the motor vehicle 10 by means of a first pivot rod 188 and a first brake piston 190. The first pivot rod 188 is pivotally interconnected at each of its respective ends with the motor vehicle 10 and the first brake piston 190. The first brake piston 190 is reciprocably disposed within a bore 192 in the first brake body 186. A braking wheel 194 is mounted to the output shaft 180, for rotation therewith, adjacent the first brake body 186. The first brake body 186 is provided with a first arcuate braking surface 196 disposed opposite the bore 192 and selectively engageable with the outer peripheral surface of the braking wheel 194. A second brake body 198, similar to the first brake body 186, is pivotally interconnected with the frame of the motor vehicle 10 by means of a second pivot rod 200 and a second brake piston 202. The second brake body is provided with a bore 204 reciprocally accepting the second brake piston 202, and a second arcuate braking surface 206 engageable with the outer peripheral surface of the braking wheel 194.

The first and second brake bodies 186 and 198 are oppositely disposed relative to the braking wheel 194 such that the first brake piston 190 and the second brake piston 202 are diametrically opposed relative to the braking wheel 194. A pair of stiff springs 208 and 210 are provided between the first and second brake bodies 186 and 198 such as to normally bias the first and second brake bodies away from each other and away from the braking wheel 194. A pair of passages 212 and 214 are provided, respectively, in the first and second brake bodies 186 and 198 to interconnect the bores 192 and 204 with the second outlet line 174 from the valve box 166. Thus, when the lever 178 of the hydraulic controller 164 is placed in the neutral position N, the bores 192 and 204 are interconnected with the pressurized hydraulic fluid from the pump 170. The pressurized fluid in the bores 192 and 204 bias the first and second brake bodies 186 and 198 into braking engagement with the braking wheel 194 by overcoming the force of the stiff springs 208 and 210. When the forward and reverse positions F and R of the lever 178 are selected, the second outlet line 174 becomes interconnected with the sump line 169 and the stiff springs 208 and 210 again bias the first and second brake bodies 186 and 198 away from each other and out of engagement with the braking wheel 194.

The first and second brake bodies 186 and 198 are disposed adjacent an annular valve member 216 fixedly interconnected with the motor vehicle 10. A cylindrical valve member 218 is provided with an outer cylindrical surface 220 engaged in an inner cylindrical surface 222 of the annular valve member 216. The cylindrical valve member 218 is further provided with an outwardly oriented radial flange 224' interposed the annular valve member 216 and the first and second brake bodies 186 and 198. Each of the first and second brake bodies 186 and 198 are provided with a plurality of parallel tongues 226 and 228, respectively, engageable with suitable grooves formed in a flat surface 230 of the radial flange 224 such that the first and second brake bodies 186 and 198 are reciprocable along their respective first and second brake pistons 190 and 202 relative to the radial flange 224. The parallel tongues 226 and 228 cooperate with the grooves of the surface 230 to prevent relative rotation between the first and second brake bodies 186 and 198 and the cylindrical valve member 218.

A plurality of abutments 232, 234, 236 and 238 are disposed radially about the braking wheel 194 at predetermined locations such as to limit the pivoting movement of the first and second brake bodies 186 and 198 about their respective first and second pivot rods 188 and 200. Thus, when the bores 192 and 204 are selectively pressurized, as described above, to bias the first and second brake bodies 186 and 198 into engagement with the braking wheel 194, a portion of the rotational energy of the output shaft 180 is delivered to the first and second brake bodies such as to pivot the first and second brake bodies. The abutments 232, 234, 236 and 238 limit the angular rotation of the first and second brake bodies to two extreme angular positions relative to the output shaft. Since the rotational motion of the first and second brake bodies 186 and 198 is transferred, by way of the parallel tongues 226 and 228 to the cylindrical valve member 218, the cylindrical valve member is rotatably driven by the output shaft 180 to one of two extreme angular positions relative thereto when the output shaft 180 is rotating and the neutral condition is selected at the hydraulic controller 164.

The annular valve member 216 is provided with an inlet passage 240 having a first end interconnected with the second outlet line 174 from the valve box 166 and a second end forming a port in the inner cylindrical surface 222, as shown generally in FIGS. 10 through 13. A first outlet passage 242 and a second outlet passage 244 are provided in the annular valve member 216 at approximately one hundred and eighty degrees (180°) away from the inlet passage 240, measured about the longitudinal axis of the annular valve member. The first outlet passage 242 has a first end interconnected by means of a line 246 to a root end 248 of a double acting cylinder 250 disposed adjacent the double acting cylinder 132 of the primary control assembly 130'. The second outlet passage 244 has a first end connected, by means of a line 252, to the cap end 254 of the double acting cylinder 250. The double acting cylinder 250 is provided with bleed holes with adjustable vents 272 and 274 formed in the root end 248 and the cap end 254, respectively, to facilitate, in a known manner, pressurization of the double acting cylinder by the hydraulic fluid supplied thereto. The double acting cylinder 250 is further provided with a piston 256 interposed the root end 248 and the cap end 254 and, accordingly, responsive to the pressure in the first outlet passage 242 and the second outlet passage 244. The piston 256 is interconnected with the stator assembly 76 such as to drive the stator assembly 76 in a manner similar to the operation of the piston 138 of the primary control assembly 130', in an appropriate manner. For example, the piston 256 may be connected in series with the piston 138 by means of a rod 258 suitably journalled, as shown at 260 in FIG. 10, and provided with suitable seals, not shown in the drawing.

The first and second outlet passages 242 and 244 each form a port in the inner cylindrical surface 222 of the annular valve member 216, as shown generally in the drawing in FIGS. 10 through 13. As shown in the developed views of FIGS. 12 and 13, the ports formed by the first and second outlet passages 242 and 244 are staggered and spaced substantially apart both axially and radially relative to each other.

An elongated passageway 262 is formed in the outer cylindrical surface 220 of the cylindrical valve member 218 to selectively interconnect the inlet passage 240 with either of the first and second outlet passages 242 and 244, depending on the angular position of the cylindrical valve member 218 relative to the annular valve member 216. The elongated passageway 262 has a partial annular portion 264 extending circumferentially at least partially around the outer cylindrical surface 220 such as to be engageable with the inlet passage 240 of the annular valve member 216 in either of the two extreme angular positions of the cylindrical valve member 218 relative to the annular valve member 216, as shown in FIGS. 11 through 13. However, the staggered positions of the first and second outlet passages 242 and 244 prevent engagement of the partial annular portion 264 of the elongated passageway 262 with either of the first and second outlet passages 242 and 244. However, the elongated passageway 262 is also provided with a transverse portion 266 extending transversely across the partial annular portion 264 for selective engagement of the first and second outlet passages 242 and 244.

In the first extreme angular position of the cylindrical valve member 218 relative to the annular valve member 216, as shown in FIG. 12, the second outlet passage 244 engages the partial transverse portion 266 of the elongated passageway 262, thereby communicating the cap end 254 of the double acting cylinder 250 with the second outlet line 174 of the hydraulic controller 164. A first sump passage 268 is formed in the cylindrical valve member 218 and interconnects the first outlet passage 242 with a suitable sump internal to the engine by means of suitable lines if necessary, not shown in the drawing, when the second outlet passage 244 is interconnected with the elongated passage 262 as described above.

When the cylindrical valve member 218 is in the second extreme angular position relative to the annular valve member 216, as illustrated in FIGS. 11 and 13, the transverse portion 266 of the elongated passageway 262 engages the first outlet passage 242 of the annular valve member 216 and, thereby, places the root end 248 of the double acting cylinder 250 in communication with the second outlet line 174 of the hydraulic controller 164. In this position, the second outlet passage 244 engages a second sump passage 270 formed in the cylindrical valve member 218 such as to place the cap end 254 of the double acting cylinder 250 in communication with a suitable sump internal to the engine by appropriate lines if necessary, not shown in the drawings.

In an intermediate position between the first and second extreme angular positions, as shown in FIG. 14, the transverse portion 266 is disposed in partial engagement with both the first and second outlet passages 242 and 244 and is further disposed between the first and second sump passages 268 and 270 such as to provide a neutral condition. This minimal partial engagement of the transverse portion 266 with both outlet passage maintains equilibrium and prevents hunting.

In operation, the servo mechanical control apparatus 160 is operated, by means of the lever 178, to select a forward driving, a braking or deceleration and stopping, and a reverse driving condition. Thus, when the motor vehicle 10 is to be driven, the lever 178 is placed in the forward position F or the reverse position R, as appropriate, and the pump 170 is interconnected with the first and third outlet lines 172 and 176 while the sump 171 is interconnected with the second outlet line 174. Thus, when the forward position F or the reverse position R is selected, the secondary control assembly 162 is deactivated and the primary control assembly 130' is operational. The primary control assembly 130' is operated to drive the motor vehicle 10 in a manner identical to that described above with respect to the primary control assembly 130.

When it is desired to decelerate the vehicle, the deceleration may be accomplished by control of the variable displacement motor 140 in the manner described above with respect to the primary control assembly 130. Alternatively, a deceleration may be accomplished by operating the lever 178 to place it in the neutral position N. In the neutral position N, the first and third outlet lines 172 and 176 are placed in communication with the sump 171, rendering the primary control assembly 130' inoperative. However, in the neutral position N, the second outlet line 174 is placed in communication with the pump 170 and, accordingly, the secondary control assembly 162 is actuated. The high pressure hydraulic fluid from the pump 170 enters the bores 192 and 204 to activate the first and second brake surfaces into engagement with the braking wheel 194. A portion of the rotational energy of the output shaft 180 is frictionally absorbed by the first and second arcuate braking surfaces 196 and 206 of the first and second brake bodies 186 and 198 such as to cause an angular displacement of the first and second brake bodies about the output shaft 180. This angular displacement is transferred, through the parallel tongues 226 and 228 to the cylindrical valve member 218 to rotate the cylindrical valve member to one of the extreme angular positions shown schematically in FIGS. 12 and 13. In either of these two extreme angular positions of the cylindrical valve member 218 relative to the annular valve member 216, either of the root end 248 or cap end 254 of the double acting cylinder 250 is placed into communication with the puap 170 while the other of the root and cap ends is placed in communication with the sump 171, thereby causing a displacement of the piston 256 in the double acting cylinder 250. Since the piston 256 is fixedly interconnected with the stator assembly 76 by means of the rods 258 and 110 and by means of the piston 138, the stator assembly 76 will be displaced in a predetermined direction relative to the circumferential inlet 62 of the power turbine 22 in response to a predetermined angular displacement of the cylindrical valve member 218 relative to the annular valve member 216. Thus, by appropriate placement of the first and second outlet passages 242 and 244, the stator assembly can be displaced to cause a reverse thrust on the axial flow vanes 53 of the turbine when the output shaft 180 is rotating in a forward direction and to apply a forward thrust on the axial flow vanes when the output shaft is rotating in a reverse direction.

It will be appreciated by those skilled in the art that the deceleration action of the secondary control assembly 162 is not substantially assisted by an ongoing braking action between the first and second brake bodies 186 and 198 and the braking wheel 194, in the preferred embodiment, since the effective life of the braking surfaces will be longer if the amount of friction between these components is minimized.

Furthermore, the deceleration action of the secondary control assembly 162 is self-limiting in the event that the displacement of the stator assembly provides a sufficient amount of torque to exceed its braking function and begin to accelerate the turbine impeller wheel 23 in an opposite direction, since the secondary control assembly 162 will immediately respond to the reverse rotational motion of the output shaft 180 by rotating from its original extreme angular position to the opposite extreme angular position, thereby repositioning the stator assembly 76.

The secondary control assembly 162 maintains the motor vehicle 10 in a fixed position when the gasifier turbine 20 is first started, or during an idling condition, so long as the lever 178 is in the neutral position N. Furthermore, the secondary control assembly 162 will act to maintain the neutral condition in the event of any instability in the turbine engine assembly 12 by responding to any small angular displacement of the output shaft 180 with a displacement of the stator assembly 76 to maintain the neutral condition. In the event that the turbine impeller wheel 23 remains interconnected with the wheels of the motor vehicle 10, the secondary control assembly 162 may be relied upon to maintain the motor vehicle in a fixed position even when it is stopped on an incline.

It will further be appreciated by those skilled in the art that upon the vehicle incorporating the inventive device attaining a downhill mode, the control may be utilized to provide a braking function by newly shifting the lever 178 to a reverse position and thereby utilize the reverse stage 78 of the stator assembly to brake the vehicle. The vehicle brakes are therefore only utilized for normal stopping on a flat surface and need not be relied upon for downhill braking applications. This is particularly adaptable to vehicles carrying heavy loads.

While the above detailed description is of the preferred embodiments of the present invention, it will be apparent to those skilled in the art that various changes and modifications may be made therefrom without departing from the spirit of the present invention. It is, therefore, intended that the appended claims will cover all such changes and modifications as fall within the true spirit and scope of the present invention.

What is claimed is as follows:

1. In a gas turbine engine for driving a vehicle, said gas turbine engine comprising a turbine housing having a free turbine wheel rotatably mounted therein, and inlet means for directing a gas radially inwardly towards said free turbine wheel, the improvement comprising:

a multi-stage stator assembly;

a reverse stage of said multi-stage stator assembly, said reverse stage having predetermined shaped reverse vanes set at a reverse preselected angle of incidence angle of incidence such as to cause a reverse rotation of said free turbine wheel while minimizing losses due to momentum when said reverse stage is positioned over said inlet means;

a forward stage of said multi-stage stator assembly disposed adjacent said reverse stage, said forward stage having forward vanes set at a forward preselected angle of incidence such as to cause forward rotation of said free turbine wheel when said forward stage is positioned over said inlet means, said multi-stage stator assembly being selectively positionable adjacent said inlet means such as to provide a simultaneous partial positioning of said reverse stage and said forward stage over said inlet means to cause said free turbine wheel to experience a zero net force, whereby said free turbine wheel is in a neutral non-driving condition;

mounting means mounting said multi-stage stator assembly to said inlet means for relative movement therebetween;

detector means interconnected with said vehicle and operative to detect the direction of angular rotation of said free turbine wheel, said detector means further comprising at least one brake body pivotally interconnected with said vehicle, said at least one brake body being selectively reciprocably engageable with said free turbine wheel for braking engagement thereof such that said detector means operatively brakes rotation of said free turbine wheel while said control means operatively maintains said free turbine wheel in an idle position while said free turbine wheel is in said neutral non-driving condition; and control means operatively connected to said multi-stage stator assembly to selectively displace said multi-stage stator assembly relative to said inlet means to cause a net torque on said free turbine wheel such as to decelerate said free turbine wheel.

2. The improvement of claim 1 wherein said multi-stage stator assembly further comprises a plurality of forward stages, each respective forward stage of said plurality of forward stages having respective vanes set at respective preselected optimum angles of incidence such as to cause forward motion of said free turbine wheel when said respective forward stage is positioned over said inlet means.

3. The improvement of claim 1 wherein said control means comprises a power actuated piston cylinder means interposed said turbine housing and said multi-stage stator assembly.

4. The improvement of claim 1 wherein each of said reverse vanes of said reverse stage is arcuate in shape such as to smoothly reverse the direction of flow of said gas to said free turbine wheel.

5. In a turbine engine for driving a vehicle, said turbine engine comprising a turbine housing having a free turbine wheel rotatably mounted therein, and inlet means for directing a gas radially inwardly towards said free turbine wheel, the improvement comprising:

a multi-stage stator assembly, said multi-stage stator assembly further comprising:

a reverse stage having reverse vanes set at a reverse preselected angle of incident such as to cause reverse rotation of said free turbine wheel when said reverse stage is positioned over said inlet means; and a plurality of forward stages, each respective forward stage of said plurality of forward stages having respective vanes set at a respective preselected optimum angle of incidence such as to cause forward motion of said free turbine wheel when said respective forward stage is positioned over said inlet means, said reverse stage being disposed adjacent a preselected forward stage of said plurality of forward stages such that a simultaneous partial positioning of said reverse stage and said preselected forward stage over said inlet means causes said free turbine wheel to experience zero net force, whereby, said free turbine wheel is in a neutral non-driving condition;

mounting means mounting said multi-stage stator assembly to said inlet means for relative movement therebetween;

primary control means operatively connected to said multi-stage stator assembly to selectively locate any of said plurality of forward stages and to selectively locate said reverse stage over said inlet means, said primary control means further comprising:

shaft means movably interconnected with said turbine housing; and first power actuated piston cylinder means fixedly interconnected with said shaft means to position said reverse stage plurality and said forward stages relative to said inlet means;

detector means interconnected with said vehicle and operatively disposed adjacent said free turbine wheel, said detector means detecting the direction of angular rotation of said free turbine wheel;

secondary control means operatively connected to said multi-stage stator assembly to selectively displace said multi-stage stator assembly relative to said inlet means in response to the detection of a direction of angular rotation of said free turbine wheel by said detector means such as to provide a torque on said free turbine wheel in an angular direction opposite said direction of angular rotation of said free turbine wheel detected by said detector means so as to decelerate said free turbine wheel; and tertiary control means selectively operable to enable and disable said primary and secondary control means.

6. The improvement of claim 5 wherein said detector means comprises:

at least one brake body pivotally interconnected with said vehicle, said at least one brake body being selectively reciprocable into braking engagement with said free turbine wheel, such that said at least one brake body is pivoted relative to said vehicle in response to the rotation of said free turbine wheel when engaged therewith.

7. The improvement of claim 5 wherein said detector means further comprises:

a brake wheel interconnected with said free turbine wheel for rotation therewith;

a first brake body disposed adjacent said brake wheel and selectively engageable with said brake wheel;

a first bore in said first brake body disposed remote from said brake wheel;

a first piston reciprocably disposed in said first bore;

a first rod having a first end pivotally interconnected with said first piston, and a second end remote from said first end, said second end being pivotally interconnected with said vehicle;

a first passage in said first brake body selectively interconnecting said first bore with a source of pressurized fluid such that, upon pressurization of said first bore, said first brake body is biased into engagement with said brake wheel, said first brake body being pivoted on said first rod relative to said vehicle in response to the rotation of said brake wheel when said first brake body is engaged therewith;

a second brake body disposed diametrically opposite said first brake body about said brake wheel;

a second bore formed in said second brake body remote from said brake wheel;

a second piston reciprocably disposed in said second bore;

a second rod having a third end pivotally interconnected with said second piston and a fourth end remote from said third end pivotally interconnected with said vehicle;

second passage means formed in said second brake body and selectively interconnecting said second bore with said source of pressurized fluid such that, upon pressurization of said second bore, said second brake body is biased into engagement with said brake wheel, said second brake body being pivoted on said second rod relative to said vehicle in response to the rotation of said brake wheel when said second brake body is engaged therewith; and biasing means normally biasing said first and second brake bodies away from each other and, hence, away from engagement with said brake wheel, said tertiary control means further comprising means for selectively pressurizing said first and second bores such as to bias said first and second brake bodies towards each other and into engagement with said brake wheel.

8. The improvement of claim 5 wherein said secondary control means further comprises:

second shaft means movably interconnected with said turbine housing;

second power actuated piston cylinder means fixedly interconnected with said second shaft means to position said multi-stage stator assembly relative to said inlet means;

first valve means fixedly interconnected with said vehicle;

second valve means interconnected with said detector means such as to be displaced by said detector means in response to a detection of a direction of angular rotation of said free turbine wheel such as to be selectively engageable with said first valve means; and passage means interconnecting said second power actuated piston cylinder means with a source of pressurized fluid, said passage means including a portion extending from said first valve means to said second valve means such that displacement of said second valve means relative to said first valve means selectively opens and closes said passage means.

9. In a gas turbine engine for driving a vehicle, said gas turbine engine comprising housing having a free turbine wheel rotatably mounted therein, inlet means for directing gas radially inwardly towards said free turbine wheel, a multi-stage stator assembly having a plurality of stator stages, including at least one forward stage and at least one reverse stage, each respective stator stage of said plurality of stator stages having respective vanes set at a predetermined respective angle of incidence, and mounting means mounting said multi-stage stator assembly to said inlet means for relative movement therebetween, wherein said at least one reverse stage is disposed adjacent said at least one forward stage such that a simultaneous partial positioning of said at least one reverse stage and a preselected one of said at least one forward stage over said inlet means causes said free turbine wheel to experience zero net force, the improvement comprising:

detector means interconnected with said vehicle and operatively disposed adjacent said free turbine wheel, said detector means detecting the direction of angular rotation of said free turbine wheel; and control means operatively connected to said multi-stage stator assembly to selectively displace said multi-stage stator assembly relative to said inlet means in response to the detection of a direction of angular rotation of said free turbine wheel by said detector means such as to provide a torque on said free turbine wheel in the direction opposite said direction of angular rotation such as to decelerate said free turbine wheel.

10. The improvement of claim 9 wherein said detector means further comprises:

a brake wheel interconnected with said free turbine wheel for rotation therewith;

a first brake body disposed adjacent said brake wheel and selectively engageable with said brake wheel;

a first bore in said first brake body disposed remote from said brake wheel;

a first piston reciprocably disposed in said first bore;

a first rod having a first end pivotally interconnected with said first piston, and a second end remote from said first end, said second end being pivotally interconnected with said vehicle;

a first passage in said first brake body selectively interconnecting said first bore with a source of pressurized fluid such that, upon pressurization of said first bore, said first brake body is biased into engagement with said brake wheel, said first brake body being pivoted on said first rod relative to said vehicle in response to the rotation of said brake wheel when said first brake body is engaged therewith;

a second brake body disposed diametrically opposite said first brake body about said brake wheel;

a second bore formed in said second brake body remote from said brake wheel;

a second piston reciprocably disposed in said second bore;

a second rod having a third end pivotally interconnected with said second piston and a fourth end remote from said third end pivotally interconnected with said vehicle;

second passage means formed in said second brake body and selectively interconnecting said second bore with said source of pressurized fluid such that, upon pressurization of said second bore, said second brake body is biased into engagement with said brake wheel, said second brake body being pivoted on said second rod relative to said vehicle in response to the rotation of said bFake wheel when said second brake body is engaged therewith; and biasing means normally biasing said first and second brake bodies away from each other and, hence, away from engagement with said brake wheel, said control means further comprising means for selectively pressurizing said first and second bores such as to bias said first and second brake bodies towards each other and into engagement with said brake wheel.

11. The improvement of claim 9 wherein said control means further comprises:

shaft means movably interconnected with said turbine housing;

power actuated piston cylinder means fixedly interconnected with said shaft means to position said multi-stage stator assembly relative to said inlet means;

first valve means fixedly interconnected with said vehicle;

second valve means interconnected with said detector means such as to be displaced by said detector means in response to a detection of a direction angular rotation of said free turbine wheel; and passage means interconnecting said power actuated piston cylinder means with a source of pressurized fluid, said passage means including a portion extending from said first valve means to said second valve means such that displacement of said second valve means relative to said first valve means selectively opens and closes said passage means.

12. The improvement of claim 9 wherein each of said reverse vanes of said reverse stage is arcuate in shape such as to smoothly reverse the direction of flow of said gas to said free turbine wheel.

13. In a gas turbine engine for driving a vehicle, said gas turbine engine comprising a turbine housing having a free turbine wheel rotatably mounted therein, and inlet means for directing a gas radially inwardly towards said free turbine wheel, the improvement comprising:

multi-stage stator vane means, movably mounted to said turbine housing, said multi-stage stator vane means further comprising:

a plurality of forward stages, each respective forward stage of said plurality of forward stages having respective forward vanes set at respective forward preselected optimum angles of incidence such as to cause forward motion of said free turbine wheel when said respective forward stage is positioned over said inlet means, said respective forward preselected optimum angles of incidence varying between said respective forward stages such as to provide a respective predetermined amount of forward thrust to said free turbine wheel when said respective forward stage is positioned over said inlet means, said respective predetermined amount of thrust being different for each of said plurality of forward stages; and a reverse stage having reverse vanes set at a reverse preselected optimum angle of incidence such as to cause reverse motion of said free turbine wheel when said reverse stage is positioned over said inlet means, said reverse stage providing a predetermined amount of reverse thrust to said free turbine wheel when said reverse stage is positioned over said inlet means, said reverse stage being disposed adjacent a preselected forward stage of said plurality of forward stages such as to permit a simultaneous partial positioning of said reverse stage and said preselected forward stage over said inlet means such that a zero net amount of thrust is experienced by said free turbine wheel whereby said free turbine wheel is in a neutral non-driving condition;

mounting means movably mounting said multi-stage stator vane means to said turbine housing such that said multi-stage stator vane means is movable along the axis of rotation of said free turbine wheel; and control means operatively connected to said multi-stage stator vane means such as to selectively locate any one of said plurality of forward stages or said reverse stage over said inlet means and further such as to selectively locate said multi-stage stator vane means to provide said simultaneous partial positioning of said reverse stage and said preselected forward stage over said inlet means.

14. The improvement of claim 13 wherein said multi-stage stator vane means further comprises a plurality of flat ring members concentric with and spaced along said axis of rotation of said free turbine wheel, each adjacent pair of flat ring members of said plurality of flat ring members fixedly securing said plurality of vanes therebetween at a preselected angle of incidence.

15. The improvement of claim 14 wherein said mounting means comprises shaft means secured to one of said plurality of flat ring members, said shaft means disposed parallel to said axis of rotation of said free turbine wheel, said turbine housing further comprising bearing sleeve means engaging said shaft means, such as to enable movement and such as to inhibit said multi-stage stator vane means from rotation relative to said turbine housing.

16. The improvement of claim 13 wherein said control means comprises power actuated piston cylinder means interposed said turbine housing and said multi-stage stator vane means.

17. The improvement of claim 13 wherein said multi-stage stator vane means is interconnected with said turbine housing such as to be simultaneously rotatable and axially movable relative thereto, said mounting means further comprising:

brake means mounted to said turbine housing about the axis of rotation of said free turbine housing wheel;

flange means fixedly interconnected with said multi-stage stator vane means; and groove means interposed said flange means and said brake means.

18. The improvement of claim 17 wherein said brake means are formed integrally with said turbine housing wherein said brake means further serve to constrain said gases in an annular path within said turbine housing.

19. The improvement of claim 13 wherein each of said reverse vanes of said reverse stage is arcuate in shape such as to smoothly reverse the direction of flow of said gas to said free turbine wheel.

20. In a turbine engine for driving a gas vehicle, said gas turbine engine comprising a turbine housing having a free turbine wheel rotatably mounted therein, and inlet means for directing a gas radially inwardly towards said free turbine wheel, the improvement comprising:

a multi-stage stator assembly comprising a reverse stage and a forward stage;

said reverse stage of said multi-stage stator assembly having predetermined shaped reverse vanes set at a reverse preselected angle of incidence, such as to cause a reverse rotation of said free turbine wheel while minimizing losses due to momentum when said reverse stage is positioned over said inlet means;

said forward stage of said multi-stage stator assembly being disposed adjacent said reverse stage, said forward stage having forward vanes set at a forward preselected angle of incidence, such as to cause forward rotation of said free turbine wheel when said forward stage is positioned over said inlet means, said multi-stage stator assembly being selectively positionable adjacent said inlet means, such as to provide a simultaneous partial positioning of said reverse stage and said forward stage over said inlet means to cause said free turbine wheel to experience a zero net force, whereby said free turbine wheel is in a neutral non-driving condition;

mounting means mounting said multi-stage stator assembly to said inlet means for relative movement therebetween;

detector means interconnected with said vehicle and operative to detect the direction of angular rotation of said free turbine wheel, said detector means comprising at least one brake body pivotally interconnected with said vehicle, said at least one brake body being selectively reciprocable into engagement with said free turbine wheel, such as to be pivotal relative to said vehicle in response to the rotation of said free turbine wheel; and control means operatively connected to said multi-stage stator assembly to selectively displace said multi-stage stator assembly relative to said inlet means to cause a net torque on said free turbine wheel, such as to decelerate said free turbine wheel.

21. The improvement of claim 20 wherein said detector means comprises at least two brake bodies disposed radially opposite each other about said free turbine wheel.

22. The improvement of claim 20 further comprising:

a bore formed in said at least one brake body, said bore being selectively interconnectable with a source of pressurized fluid;

piston means reciprocably disposed in said bore; and a pivot rod having a first end pivotally interconnected with said piston means and a second end remote from said first end pivotally interconnected with said vehicle whereby said at least one brake body is selectively driven into engagement with said free turbine wheel upon pressurization of said bore.

23. The improvement of claim 20 further comprising:

an output shaft mechanically interposed said free turbine wheel and said at least one brake body, said output shaft being rotatably driven by said free turbine wheel; and a brake wheel interconnected with said output shaft for rotation therewith and mechanically interposed said output shaft and said at least one brake body such that said at least one brake body is selectively engageable with said brake wheel for braking engagement with said free turbine wheel.

24. The improvement of claim 20 wherein said control means comprises:

a power actuated piston cylinder means interposed said turbine housing and said multi-stage stator assembly; and passage means extending between said power actuated piston cylinder means and a source of pressurized fluid, said passage means being selectively opened and closed in response to the pivoting motion of said at least one brake body.

25. The improvement of claim 24 wherein said control means further comprises:

a first valve member fixedly interconnected with said vehicle; and a second valve member disposed adjacent said first valve member and interconnected with said said at least one brake body for rotation therewith, said passage means extending from said first valve member to said second valve member such that said passage means is selectively opened and closed by rotation of said at least one brake body relative to said vehicle.

26. The improvement of claim 20 further comprising:

abutment means fixedly interconnected with said vehicle, said abutment means limiting the pivotal motion of said at least one brake body relative to said vehicle.

* * * * *

UNITED STATES PATENT AND TRADEMARK OFFICE

CERTIFICATE OF CORRECTION

PATENT NO. : 4,688,663

DATED : August 25, 1987

INVENTOR(S) : William C. Marchand

It is certified that error appears in the above-identified patent and that said Letters Patent is hereby corrected as shown below:

Column 5, line 24, delete "plonar" and insert ---- planar ----.

Column 7, line 59, delete "element" and insert ---- elements ----.

Column 8, line 9, after "94c" insert a comma ---- , ----.

Column 8, line 44, before "double" insert ---- the ----.

Column 8, line 59, before "control" insert ---- primary ----.

Column 12, line 12, delete "224'" and insert ---- 224 ----.

Column 14, line 10, delete "passage" and insert ---- passages ----.

Column 14, line 57, delete "puap" and insert ---- pump ----.

In the Claims

Column 16, line 4, delete "incidence angle of incidence" and insert ---- incidence ----.

Column 17, line 31, delete "stage plurality and" and insert ---- stage and said plurality of ----.

Column 18, line 66, after "comprising" insert ---- a turbine ----.

Column 19, line 67, delete "bFake" and insert ---- brake ----.

Column 20, line 21, after "direction" insert ---- of ----.

UNITED STATES PATENT AND TRADEMARK OFFICE

CERTIFICATE OF CORRECTION

PATENT NO. : 4,688,663

DATED : August 25, 1987

INVENTOR(S) : William C. Marchand

It is certified that error appears in the above-identified patent and that said Letters Patent is hereby corrected as shown below:

Column 20, line 56, before "thrust" insert ---- forward ----.

Column 21, line 51, after "housing" insert a comma ---- , ----.

Column 21, line 58, before "turbine" insert ---- gas ----. Same line, delete "gas vehicle" and insert ---- vehicle ----.

Column 23, line 11, delete "said", second occurrence.

Signed and Sealed this

Twenty-fourth Day of May, 1988

*Attest:*

*Attesting Officer*

DONALD J. QUIGG

*Commissioner of Patents and Trademarks*